US008684230B1

(12) United States Patent
Greenberg

(10) Patent No.: US 8,684,230 B1
(45) Date of Patent: Apr. 1, 2014

(54) TWISTABLE AND COLLAPSIBLE CONTAINER FOR DISPENSING MEASURED DOSAGES OF LIQUID

(76) Inventor: Russell Jon Greenberg, New York, NY (US)

( * ) Notice: Subject to any disclaimer, the term of this patent is extended or adjusted under 35 U.S.C. 154(b) by 92 days.

(21) Appl. No.: 13/495,848

(22) Filed: Jun. 13, 2012

Related U.S. Application Data

(60) Provisional application No. 61/520,644, filed on Jun. 14, 2011.

(51) Int. Cl.
*B65D 35/00* (2006.01)
*B65D 35/28* (2006.01)

(52) U.S. Cl.
USPC ..... 222/107; 222/95; 222/104

(58) Field of Classification Search
USPC ..... 222/39, 95, 104, 107, 552, 633; 220/666, 669; 206/218; 215/900
See application file for complete search history.

(56) References Cited

U.S. PATENT DOCUMENTS

| | | | | |
|---|---|---|---|---|
| 2,886,084 | A | 5/1959 | Davison | |
| 3,155,281 | A | 11/1964 | Stracey | |
| 3,873,003 | A | 3/1975 | Seiferth et al. | |
| 4,341,330 | A * | 7/1982 | Mascia et al. | 222/401 |
| 4,955,493 | A * | 9/1990 | Touzani | 215/372 |
| 5,186,361 | A | 2/1993 | Williams | |
| 5,269,428 | A | 12/1993 | Gilbert | |
| RE36,377 | E * | 11/1999 | Gilbert | 215/382 |
| 6,702,143 | B2 * | 3/2004 | Wang | 220/666 |
| RE38,770 | E | 8/2005 | Gilbert | |
| 7,866,500 | B1 * | 1/2011 | Peggs | 220/6 |
| 2010/0133281 | A1 * | 6/2010 | Wojcik et al. | 220/666 |

FOREIGN PATENT DOCUMENTS

| | | | | |
|---|---|---|---|---|
| EP | 406134 | A1 * | 1/1991 | B65D 1/02 |

* cited by examiner

*Primary Examiner* — Paul R Durand
*Assistant Examiner* — Vishal Pancholi
(74) *Attorney, Agent, or Firm* — Andrew S. Langsam; Pryor Cashman LLP

(57) ABSTRACT

A collapsible container for dispensing viscous materials has a bottle section with exterior screw threads and a cap element with nozzle aperture and internal, mating yet greater in density screw threads so that relative turning of the bottle section with respect to the cap section causes dispensing of material and collapsing of the bottle section into the cap element. The exterior screw threads are provided with uniformly spaced surface discontinuities. The cap element is provided with a resilient, inwardly directed tab which glides over the exterior edge of the screw threads of the bottle section as the bottle section is rotated with respect to the cap element until the tab aligns with a discontinuity thereof which causes an audible or tactile click to be sensed for ensuring uniformity and ease of exact dosing.

18 Claims, 9 Drawing Sheets

TWISTABLE AND COLLAPSIBLE CONTAINER FOR DISPENSING MEASURED DOSAGES OF LIQUID

RELATED APPLICATIONS

The present application claims priority on U.S. Provisional Patent Application Ser. No. 61/520,644 filed Jun. 14, 2011. The specification and teaching of that reference is specifically incorporated herein.

BACKGROUND OF THE INVENTION

The present invention relates to a collapsible and twistable or turnable container/bottle that collapses and dispenses liquid in a predetermined exacting dosage. Furthermore, the present invention provides an audible and/or tactile means for indicating to the user the exact amount of liquid being dispensed. Basically, the invention comprises a cylindrical, bottle-shaped, preferably thin-walled plastic, collapsible container having exterior screw threads and a closing and nozzle-providing cap attached to the bottle. In one embodiment, the bottle is provided with a surrounding collar having at least one thread-like turn, near its open end. The bottle can be rotated and thus collapsed into the collar secured to the distal or open end of the bottle. The bottle is provided with one or more surface discontinuities on its helical surface and cooperates with an inwardly protruding and resilient lug of the collar to provide for audible and/or tactile metered dosing of liquid from the bottle.

Alternatively, the bottle is provided with a turnable nozzle or cap element relative to the bottle section with the cap element having a plurality of internal screw threads. The interior screw threads of the cap element, with a nozzle opening for release of the contents of the bottle, cooperate with the exterior screw threads of the bottle section which allow the bottle to be turned and twisted with respect to the cap element and thus collapsed into the cap. Stated differently, the helical threads of the bottle component are turned and twisted and received into the threads of the cap and the threads of the cap, being closer together (having greater number of threads per unit of length than that of the uncollapsed bottle section) cause the bottle to collapse along its length and be stored within the cap element.

Extending around the outside of the bottle portion of the container and spanning the length of the same, is an external set of screw threads. These coil around the circumference of the bottle, starting near the closed top thereof and ending at the point where the bottom or open end of the bottle meets the cap element, having the dispensing nozzle. In one embodiment, the cap element is secured to the bottle and a collar is provided which collects the threads of the collapsible bottle, as it is turned and collapsed into the collar. Alternatively, in another embodiment, Inside the cap element, and extending around its internal circumference, is a matching set of screw threads (i.e., matching in outside diameter to the screw threads of the bottle) which cooperate with the screw threads of the outside of the bottle portion. In either embodiment, when the bottle is turned with respect to the collar or when the cap element with internal threads is turned with respect to the bottle component, the threads of the outside of the bottle engage a single thread of the collar or the threads of the internal surface of the cap element. Turning with respect to one another causes the longitudinal collapse of the bottle (wither collected within the collar or collected by the cap element) as the screw threads are received and held within the screw thread of the collar or the internal threads of the cap element. In the embodiment having the collar, one end of the collar has an interior-directed flange which causes the screw thread of the bottle to enter the collar and be collapsed and maintained there, i.e., within the open or head space of the collar. Alternatively, in the embodiment with the internal screw threads for the cap element, the screw threads of the cap element are closer to one another than the uncollapsed screw threads of the bottle, the relative turning causes a longitudinal collapse and securement of the bottle within the cap element.

Important to the present invention is an audible and/or tactile mechanism, preferably a set of spaced recesses on the outside of the bottle section (either discontinuities on the outside edge of the screw thread of the bottle or on a portion of the plane defining the helical screw thread) which cooperate with a fixed and inwardly protruding yet resilient lug on the inside of the collar or cap element (depending upon embodiment). Of course, the lugs and discontinuities could be reversed, i.e., resilient tabs spaced around the exterior of the bottle cooperating with a recess on the inside of the collar or cap element) so that each time a recess passes by the resilient lug (in the preferred embodiment) an audible sound of plastic snapping (from movement of the lug out of and then into the recess) is heard and/or a tactile "snap" is felt so that the user is alerted to the precise rotation of bottle section with respect to collar or cap element and this, in turn, relates to precise measure of dispensed liquid—as the recesses are located and uniformly spaced about the device, i.e., on the helical screw threads or the edge of the screw threads of the bottle section. Thus, each relative rotation of the bottle with respect to the cap element, either a ¼, ½ or full turn, for example, will make an audible "snap" as the lug first glides over and along the outside edge of the helical screw thread until it snaps into the recess (a surface discontinuity in the smooth edge of the screw thread) and/or a tactile snap is felt, too, alerting the user that a predetermined amount of bottle length has been captured in the collar or cap element and, thus, the predetermined amount of liquid dispensed (as the cap or inside threaded cap element has an opening or nozzle passing therethrough, allowing liquid to flow from bottle section, through hollow cap element (after the closure to the nozzle of the cap is removed) and then through the nozzle opening).

The snap mating of discontinuities and lug or tabs can also act as a locking feature to prevent the bottle from being screwed back out (extending the same from its collapsed partial or full condition). The lug or tabs can be unidirectional, like a ratchet, allowing for one way turning movement of bottle with respect to collar or cap element (collapsing the same and dispensing material) but not allowing for reverse relative turning of the bottle with respect to the collar or cap element, after the discontinuity of the bottle has been captured by the tab or lug of the collar or cap element.

The unique, possibly iconic shape and mechanical design of the bottle and collar or cap element with nozzle (different embodiments, each of which cooperates with a bellows-like externally screw threaded bottle section) allows the bottle to collapse into the chamber formed within the collar or cap element while giving a positive reassurance signal (a clicking sound and/or feel) to the user each time a certain "preferred" amount of twisting is accomplished, correlating to an amount of liquid or at least partially viscous material being dispensed. Texutre, too, along the bottle wall can be employed to advantage, which can mechanically engage or interfere with the lug of the collap/cap elemnt iin a manner that a subtle ratcheting noise is provided when relative turning is performed.

The bottle section, threads, the collar and/or cap element, its single thread or multiple threads, respectively, are designed so that a specific angular relative rotation of the holding chamber or bottle section with respect to the collar or cap element, or a sensed number of clicks, indicates a certain amount of liquid dispensed for that amount of turning. As an example, if one turn, or a 90 degree rotation, dispenses 50 milliliters of fluid, then in order to dispense 100 milliliters, a user would twist the bottle for a 180 degree rotation, or until two clicks are heard or felt.

The twistable bottle section and collar/cap element makes possible this controlled, incremental dispensing of liquid by creating a clicking sound, possibly in combination with an increased resistance and/or the feel of the bottle having found a "resting place" within the collar/cap element, every time the unique corkscrew-like shaped bottle with equally spaced registration recesses or protrusions, tabs or marks align with and cause the tab or lug on the inside of the collar/cap element to glide over the smooth edge of the helical screw threads (or on a plane of the helical thread) of the bottle section until the lug snaps, by its resilience, into the recess or surface discontinuity of the screw thread of the bottle section. As the lug or inwardly directed tab of the collar/cap element contacts and passes into the discontinuity/recess of the bottle section, the lug's resilience to snap back to its shape before being caused to glide over the outer edge (or planar surface) of the helical screw threads of the bottle section will cause a click to be audible or tactilely sensed. This signals that a measured dose of liquid is dispensed, with a specific measurement correlated with each relative angular turn or twist of the bottle.

As an additional feature of the present invention, instead, as is common in conventional soda or liquid dispensing bottles, where the bottle or chamber portion becoming increasingly empty as the liquid is dispensed, according to the present invention, the overall volume or size of the bottle shrinks. Through each successive twist of the bottle with respect to the collar or cap element, the exterior-directed screw threads of the chamber are screwed into and collapsed and maintained by the internally-directed screw threads of the collar/cap element. Once the top of the bottle (which can serve as the bottom of the bottle when dispensing is not occurring, i.e. the base of the bottle section can be the sitting point of the bottle on a table until and unless liquid is desirably dispensed) is compressed by turning and reaches the top lip of the collar/cap element by the exterior screw threads of the bottle being captured within the internal screw thread/threads of the collar/cap element, respectively, the device is fully collapsed and can be discarded. As taught above, the screw threads of the exterior of the bottle will be captured within the collar/cap element by the internally and matingly sized screw thread of the collar or the interal screw threads of the cap element. The screw threads of the cap element are closer together than the screw threads of the outside of the bottle, at least before engagement with the threads of the cap element. The compression of the volume of the threaded bottle compartment into the collar or into the cap element correlates with dispensing of the concentrated liquid through the opening of the nozzle of the cap of the device as the liquid is substantially incompressible such that once air within the bottle is squeezed out, further turns of bottle with respect to collar or cap element cause the liquid to flow out and through the aperture/channel of the nozzle from the cap. Depending on the viscosity of the liquid being dispensed, different nozzle details (with or without silicon gaskets or equivalent) can be used to prevent unwanted spillage or liquid overflow.

There are multiple advantages to this collapsible design, including, but not limited to, that few injection molded parts are necessary to the functionality of the invention (i.e. a cap instead of a cap and a base). Alternatively, in the embodiment of the invention using a bottle section, a cap secured to the bottle (with a sealing cap and a pour opening or nozzle chamber) and a collar, while more parts are needed, they are inexpensive, easy to make and provide an excellent solution to the problem of providing an inexpensive, collapsible, fluid-dispenisng bottle, which provides for precisely metered dosing or dispensing of fluid/material.

When the external screw threaded or corkscrew-shaped bottle base is twisted and collapsed into the hollow chamber defined by the interior of the collar or in the other embodiment, the chamber of the cap element, the compression of the bottle, acting on the incompressible liquid contained therein, once the air is first expelled, mechanically dispenses the liquid. Small and resilient tabs or recesses/registration marks (often referred to herein as surface discontinuities) are distributed at regular intervals along the length of the exterior screw threads of the bottle, either on the plane of the screw thread or directly on the edge of the screw thread. These discontinuities, whether tabs or recesses, will align with and then glide over a single corresponding inwardly protruding lug or inwardly projected tab in the rim of the collar or the cap element. Or, in the preferred embodiment, the lug of the collar or of the cap element glides over the screw threads of the bottle section until the lug/tab snaps into the discontinuity or recess of the screw thread. As a consequence of the gliding over and then resilient snapping back of the lug (from being bent outwardly by the relative protruding edge of the threads of the bottle section vis a vis the recess or discontinuity) as the bottle is turned with respect to the collar or the cap element, a clicking sound, which signals a full or partial rotation of the bottle into the base, occurs. This audible and tactile signal indicates an amount of relative turning and correspondingly indicates a predetermined dosage of liquid being pushed out of the nozzle of the cap. Since the recesses or protruding tabs are all the same size and all equally spaced apart along the spiral defined by the exterior screw threads of the bottle, each full or partial rotation allows for an equal dosage of liquid to dispense through the pour opening or the nozzle. The clicking sound and/or tactile feel alerts the user that the measured dose of liquid, i.e. the amount which correlates to each partial or full turn of the bottle, has been dispensed.

In one embodiment, an additional advantage to the present invention is provided such that the bottle component of the invention is removable and disposable, and ideally recyclable. This allows a user to merely purchase replacement bottles filled with desired liquid (most likely medicine or a viscous liquid-like soap or detergent) while reusing the collar or the cap element, the latter having a dispensing nozzle. Replacement bottle sections, filled with new dispensable viscous material, can have a simple closure or seal (or a safety and/or hinged cap) which is removed when the bottle is initially intended to be used. In the embodiment employing a collar, the bottle is provided with a closure and a hinged cap for the pour opening. When the bottle is turned, the cap and hinged cap may turn but turning of the bottle causes the dollar to received the turns of the screw threads of the bottle which are then captured in the open head end of the collar—thus compressing the bottle within the collar. In the embodiment employing a cap element with a plurality of screw threads for receipt of the helical threads of the bottle, the bottle section is screwed into the cap element. Since, in both embodiments, the bottles are all designed to be somewhat uniform and thus most will fit in and collapse into a standard collar or cap element, only one may need to be purchased for each type of collapsing device (whether of the collar variety or the cap element with multiple internal screw threads). In an alternate embodiment, the bottle components could be refillable and reusable. In another embodiment, of course, the bottle section and the collar/cap element are disposed upon full dispensing of the liquid and collapsing of the bottle within the collar or the cap element. Different shaped bottles with different thread dimensions and recess locations (discontinuities) will be able to deliver different products at different preferred and meansured dosages.

A principal thrust of the present invention lies in the audible and/or tactile "notification" to the user that a relative turn or twist has been made by the bottle enough to discharge a pre-determined amount of liquid from within the bottle and out through the pour opening or nozzle of the cap. When a user turns the bottle with respect to the capturing thread(s) of the collar or cap element, such that it begins to coil into the collar/cap element, a specified amount of liquid is dispensed.

In the collar and cap element embodiments, the first having a single screw thread to coil the bottle as it is turned and the other having multiple interior screw threads, the collar or the cap element is a substantially hollow accepting or "holding chamber" for the liquid to be dispensed through so that when its contents are dispensed out the nozzle or pour opening, an equal amount of liquid takes its place in the chamber, ready to be dispensed by a subsequent relative rotation of bottle section (holding the bulk of the liquid) and the collar or cap element. According to the embodiments of the invention, upon each partial or full rotation, the bottle section pushes on a tab which otherwise inwardly protrudes from the collar or cap element. This serves two functions. First, it can open the aperture or channel/liquid pathway at the bottom of the collar or cap element (if the tab otherwise blocks the nozzle) which allows the liquid to pass through and be dispensed and second, as the bottle/container is turned and the tab/recess of the bottle realigns with another lug or tab in the inside chamber of the collar or cap element, the tab will resiliently "snap" back into place, making a clearly audible and/or tactile clicking sound or feel. This snapping will also communicate to the user (as the plastic of the bottle and the liquid contained therein seem to amplify or at least transmit the snap) into a tactile feel. This indicates to the user that the desired amount of liquid, or that amount equal to one full or partial turn of the container, has been dispensed. To dispense more liquid than the per-turn dosage, a user must simply continue to twist the bottle until they hear as many clicks as are equal to the amount desired. This will cause dispensing of the liquid in relation to the clicks heard or felt and, at the same time, cause the bottle component to shrink or be captured into the collar/cap element, as the screw threads of the bottle section are captured by the collar or the cap element. Thus, for example, if the separation of screw threads of the bottle section, when filled with liquid, is 1 screw thread for each inch of length of bottle then, realistically, the screw thread separation in the cap element may be compacted to about 5 threads per inch. This would allow 10 inches of bottle length to be compressed into 2 inches of cap element. In the embodiment wherein a collar is used which has a single compressing helical screw thread at its distal end, i.e., opposite the open end of the bottle, the open head of the collar allows for many multiple turns of thread of the bottle section to be contained as the bottle section is rotated vis a vis the collar.

The audible and/or tactile sensor is extremely useful to alert users as to how far to rotate the container to dispense the desired amount of liquid. For individuals who are not skilled in mathematics, or who may not remember the exact measurement of liquid needed, it would be extremely easy to instruct them, for example, to "turn three clicks." This way, when the user hears the number of tab "snap backs" or they feel that number of clicks, they know they have completed the proper dispensation of the desired dosage. This prevents a user from turning the container too much or too little, especially in the case where it may contain a medicine which requires precise measurement.

Visual markers may also be integrated into the label or the side wall of the bottle that correspond with the snap feature. For example, for a medication there can be a date printed adjacent each snap feature so an elderly patient can easily and accurately keep track of the last time (date) they took their medicine. The nap feature, i.e., combination of surface discontinuity in the side wall or thread of the bottle section and the tab or lug of the collar or cap element, along the length of the bottle section can serve as a timeline and reminder to the patient seeing precise dosage of medication.

DESCRIPTION OF THE PRIOR ART

A twistable, collapsible container is disclosed in the prior art. Specifically, Stracey, U.S. Pat. No. 3,155,281, discloses a container with a main chamber, a smaller chamber, and a dispensing device for dispensing powders, pastes, sticks or liquids. The main chamber of the container contains a continuous helical bellows which connects into an internal thread on the cap. In order to dispense liquid, the container collapses into a small chamber holding a predetermined amount of liquid, which is then released. As the liquid continues to dispense, the main chamber twists along the helical bellows and begins to collapse into the smaller chamber. This is quite similar to one aspect of the present invention. There is, however, no teaching or suggestion of any mechanism for audibly or tactilely providing a means to precisely sense the dosing of the fluid from such a collapsible container. Similarly, there is no teaching nor suggestion of the use of a simple hollow collecting collar to casue the collapse of the bellows-like bottle section into a hollow collar without the frictional resistance which will occur as a consequence of the use of a set of internal screw threads on the cap element. The use of a collar having a single collapsing thread and a storage area or chamber for the bellows of the bottle section eliminates the frictional resistance of collapse of the prior art and makes for a far easier and more efficient manner of operation.

Additionally, Gilbert, U.S. Pat. No. RE38,770, discloses a collapsible container with a helical thread which twists and collapses into a screw thread in its base. Gilbert's device is specifically designed to reduce the volume inside the container after liquid is dispensed, to prevent aeration of a carbonated beverage. Like Stracey, it turns along the helical contours until it fully collapses and all liquid has been dispensed. This, too, is similar to one aspect of the mechanical dispensing of liquid from the bottle and collar/cap element of the present invention.

However, the prior art does not teach nor suggest, when individually considered or even if combined, a collapsible, thin-walled, easy to make and inexpensive liquid dispensing bottle or container which provides an audible and tactile notification to the user when an exact amount of liquid is dispensed or the number of turns for the container has been accomplished. In one embodiment, the external wall of the cylindrical bottle section or container of the present invention contains a series of evenly spaced discontinuiites, whether ridges or recesses along the helical path of screw threads on the outside wall of the bottle section. A collar or cap element is provided with a resilient, inwardly protruding lug and, in the embodiment of the cap element, a corresponding yet tighter pitch of mating, internal screw threads. In the embodiment using the hollow collar, a single thread or rotation is employed to cause the collapse of the screw threads of the bottle and the collapsed screw threads are collected between a bottom flange of the collar and the top screw thread of the collar. As the bottle/container is turned along its helical path, which collapses it into the collar or the screw threads of tighter "pitch" in the cap element, the lug protruding from the inside of the collar/cap element, bears against and glides over the edge (or a planar surface) of the exterior screw threads of the bottle section until is aligns with a recess. The resilience of the lug when allowed to snap back to its centrally biased position, by the presence of the recess, causes an audible click or snapping feel. When the rotation of the bottle or cylinder is initiated, the lug or tab of the collar or cap is pushed outwardly from its normally or radially-inward biased direction, as the lug or tab glides over the edge of the screw thread. Then, when it aligns with a discontinuity or recess of the screw thread of the bottle section, it snaps back into its radially inwardly orientation, causing the click as it (the lug) is resilient. This allows a specified amount of liquid to be released through the aperture or hole in the bottom of the nozzle of the cap. As the bottle is further rotated, the lug or tab starts to glide over, again, the outside edge of the screw threads of the bottle until it meets with and snaps into the next successive discontinuity or recess in the exterior thread of the bottle. In one embodiment, this will not only close off the nozzle opening to any further liquid, but also makes an audible snapping or clicking sound to indicate that the lug or protruding tab of the collar or cap element has moved from one recess or ridge to the next. By making this noise, a user is made aware that a proper rotation of the device has been made, and that the appropriate amount of liquid equated with one or more clicks has been dispensed. This eliminates the possibility of a user turning the cylinder too much or too little because they were unaware of the precise required rotation for a desired dosage.

Additionally, the lug or tab of the collar or cap element will automatically, upon being released from one recess or ridge, slide along and over the edge or a surface of the helical spiral or external screw threads of the bottle and lodge itself in the next successive discontinuity or recess or ridge. The shape of the helix makes this possible, because the screw thread section not provided with a discontinuity or recess or ridge forces the lug or tab to glide over the edge or planar surface of the screw thread until there is a place for it to snap inwardly (the next recess or tab) where it will be maintained until another rotation or partial rotation of the bottle is initiated. This creates a tactile acknowledgement to a user, because the snap of the lug or tab into the recess or ridge will happen automatically once the tab has been moved from the previous recess to the edge or planar surface of the screw threads and then into the next recess. Therefore, even for a user who is hard of hearing, or if the device is used in a noisy environment, a user can be sure that he has made a proper rotation of the device by sensing or feeling the lug or tab movement and snapping, a consequence of camming, resilience and rigidity of relative moving parts. This is not taught by the prior art.

SUMMARY OF THE INVENTION

The present invention relates to a twistable or relatively turnable and collapsible container for dispensing liquids or viscous materials, comprising a main bottle or housing, comprising a flexible, thin wall, collapsible in length bottle compartment for holding liquid or viscous material. The exterior of the bottle section is provided with a set of uniformly spaced screw threads. Located along the screw threads are a set of discontinuities, preferably small surface recesses equally spaced throughout the length of the spiral created by the helical screw threads. The bottle section being substantially hollow or comprising a chamber or base holds the liquid to be dispensed by the container. Dispensing occurs when the bottle is rotated relative to a collar or cap element.

In one embodiment, the bottle is provided with a cap at its otherwise open end. The cap is provided with a hinged or sealable safety closure. Rotation of the bottle causes this cap to correspondingly rotate. Removal of the hinged safety closure or foil-like seal will open a fluid pathway from the hollow interior of the bottle section through the cap and out the nozzle or pour opening of the container.

In this cap embodiment, a collar is provided, rotatively secured about the part of the cap which is secured to the open mouth of the bottle section. The collar is substantially hollow and toroidal in general shape, i.e., like a donut. One end of the collar is a base flange which surrounds the outside helical threads of the bottle section and is greater in diameter than that of the helical threads of the bottle section. The other end of the collar is provided with a single helical thread which matches the diameter of the helical threads of the bottle section. That single thread of the collar accepts the helical ends of the bottle section and, as the bottle section is rotated with respect to the stationary collar (or rotation of the collar about the helical threads of the bottle section) the bottle section and its threads are squeezed together, collapsing the bottle section as it passes past the thread of the collar and, yet, the front end of the helical screw threads on the bottle section will be collected in the collar as the flange prevents the helical threads from passing out of the collar. Thus the screw threads of the bottle section are collapsed within the hollow interior of the collar, as the trailing helical thread of the bottle section successively passes through and into the collar.

Also, an interior directed, resilient, and inwardly biased lug or tab is provided within the collar. The tab cooperates with the discontinuities or recesses on the helical screw thread of the bottle section to provide an audible click or feel to each time that the bottle section is rotated with respect to the lug of the collar as the lug or tab is caused to ride over the edge or planar surface of the helical screw thread of the bottle section and then dip into and be click/captured into the discontinuity or recess. As a consequence of the bias and the resilience of the lug/tab, each alignment between lug or tab with the discontinuity or recess of the external screw thead of the bottle section will cause the container to click audibly and/or for the click to be felt by a user.

Another embodiment of the invention contemplates the use of a cap element with a series of internal threads for capturing and compressing the helical threads of the bottle section. The cap element has a central hole or aperture through which the liquid will be dispensed when the bottle section is rotated with respect to the cap element. The cap element is provided with a continuous screw thread on its interior, of the same outside diameter as the screw thread of the bottle section but with the spacing between rotations of the screw thread of the ccap element being more compact than those of the bottle section. Thus, for example, if the spacing of the screw threads on the bottle section is 10 turns for each 10 inches of uncompreessed bottle length, the spacing of the screw threads within the cap element may be 10 turns for each inch of cap element. Thus, 10 inches of bottle can be screwed into and collapsed and held by a single inch of height of cap element. As in the embodiment of the invention utilizing a collar, a resilient, radially inwardly protruding tab or lug is inside of the cap element. It is biased inwardly but adapted to be forced outwardly (from its radially inwardly projected position) as it glides over the screw threads of the bottle section and, yet, when the discontinuity or recess of the screw threads of the bottle section align with the tab or lug of the cap element, the resilient tab will pop back into the recess, i.e., back to its spring-biased radially inwardly direction, and, in doing so, make a slight clicking sound which may also be sensed by the user. Thus, the degree of turning of the elements, bottle section or container with respect to cap element, will be audibly and tactilely sensed. As the bottle is turned relative to the cap element, the liquid is forced out of the bottle, into the cap element and out through the pour opening or aperture of the cap element. The number of clicks/tactile feels of the rotation of the bottle with respect to the cap element will directly correspond to the quantity of liquid being dosed by that rotation. The open bottom of the bottle is connected to the open top of the cap element.

When sitting on a table surface, the closed and when dispensed top end of the bottle section will sit on the table with the pour opening with collar or cap element above. Alternatively, the base of the cap and/or the bottle section can be flat for allowing either end to stably sit on a table surface. When fluid or liquid or any viscous substance is sought to be dispensed, the device is inverted, with pour opening located downwardly i.e., collar or cap element and nozzle facing down, with closed end of the bottle section directed upwardly. Relative rotation of the bottle section with respect to the collar or cap element is then performed. This will dispense fluid out the pour opening of the container and the number and feel of clicks will indicate to the user the quantity of material dispensed. The turning of the bottle with respect to the collar or cap element will casue the bellows-like bottle section to be compressed and held within either the collar or the cap element.

According to an aspect of the invention, a hinged safety cap can be provided to the cap or cap element to close the pour opening of the same when the device is awaiting use. When dispensing is desired, the hinged cap is moved to expose the pour opening of the ccap or cap element. When dispensing of material is desired, relative rotation is performed between collar or cap element and bottle section and the rotation of the bottle causes its threads to thread into and be captured by the thread of the collar or the multiple threads of the cap element. This causes dispensing of material (liquids are substantially incompressible) and collapsing of length of the bottle as it gets screwed and captured within the collar or cap element. The threads and the bottle are collapsed and held within the collar or cap element during collapsing, a consequence of the combination of the holding flange and the collapsing thread of the collar or the closer spacing of the screw threads in the cap element with respect to the expanded or uncollapsed spacing of the screw threads of the bottle section. Also, the movement of the resilient lug or tab of the collar or cap element as it rides over the external edge or surface of the threads of the bottle section until it aligns with a discontinuity or recess or ridge of the same, causes the click and tactile feel of relative, predetermined amounts of rotation. This is a function of the resilience of the tab, of course and its gliding over the edge of the screw threads of the bottle section and snapping back, inwardly, when the tab or lug aligns with a discontinuity/recess of the bottle section's screw threads. When the tab or lug is released from the recess, by another or continued relative manual rotation of bottle section with respect to collar or cap element, a predetermined amount of liquid is again released from the container through the pour opening or aperture of the cap until another click is heard and/or sensed click is felt. As liquid is dispensed from the container, the container collapses into the collar or cap element until it is entirely captured and stored within the same and the bottle section is empty.

DETAILED DESCRIPTION OF THE INVENTION, THE PREFERRED EMBODIMENT AND THE DRAWINGS

Figure 10:
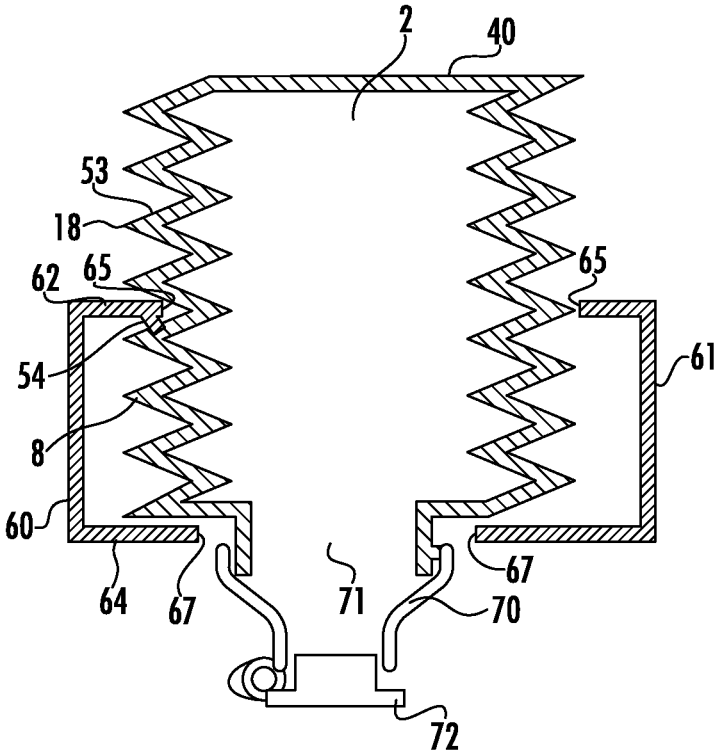
FIG. 10 is an enlarged partial and cross sectional view of a bottle section of the present invention, showing an alternate and preferred embodiment, the use of a collar and a cap and hinged safety cap secured to the bottle section and defining a pour opening.
Figure 11:
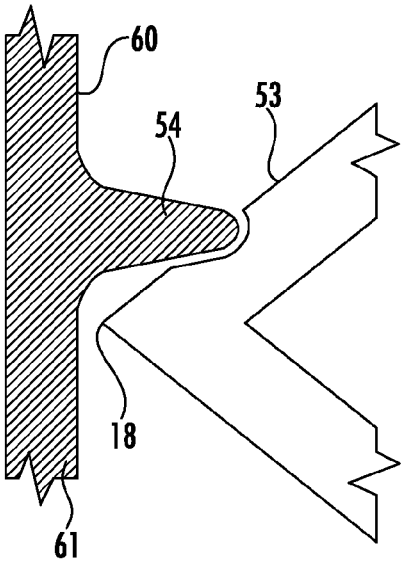
FIG. 11 is an enlarged and sectional view of the embodiment of FIG. 10 and shows the mechanical interaction of the lug or tab of the collar and the discontinuity or recess in a planar surface of a helical rotation of the screw threads of the bottle section.
Figure 12:
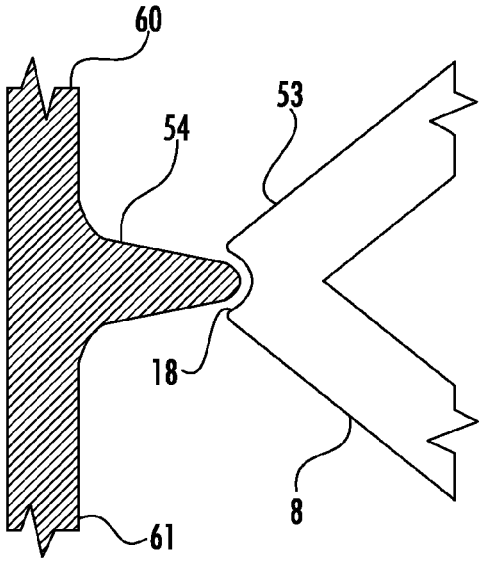
FIG. 12 is an alternate embodiment of the invention shown in FIG. 11 and shows the mechanical interaction of a tab or lug of the collar with the discontinuity or a recess in the edge of one of the helical rotations of the screw threads or revolutions of the bottle section.

Description will now be given of the one of the embodiments of the invention with reference to the attached FIGS. 1-9. The currently preferred embodiment of the invention, using a bottle section, a cap and hinged safety cap and a separate collar is shown in FIGS. 10 through 12. It should be understood that these figures are exemplary in nature and in no way serve to limit the scope of the invention as the invention will be defined by claims, and the scope of the invention will be the scope of the claims, as interpreted by the Courts.

Figure 1:
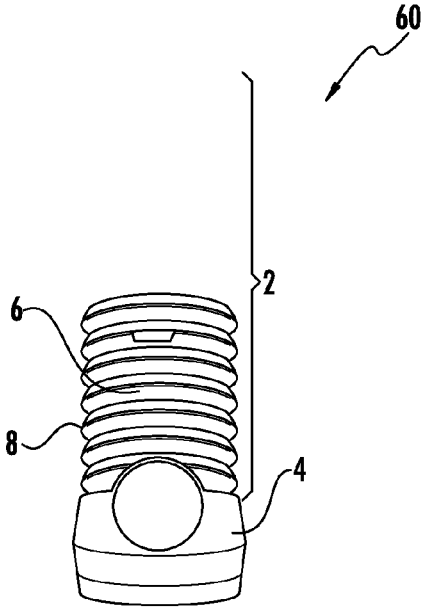
FIG. 1 is a front perspective view of the present invention, a twistable or turnable and collapsible precise dosage container comprising a cap element (on bottom, sitting on a table surface) and a collapsible bottle section (located above the cap element on the table), and showing the bottle section as it is collapsing into the cap element.
Figure 2:
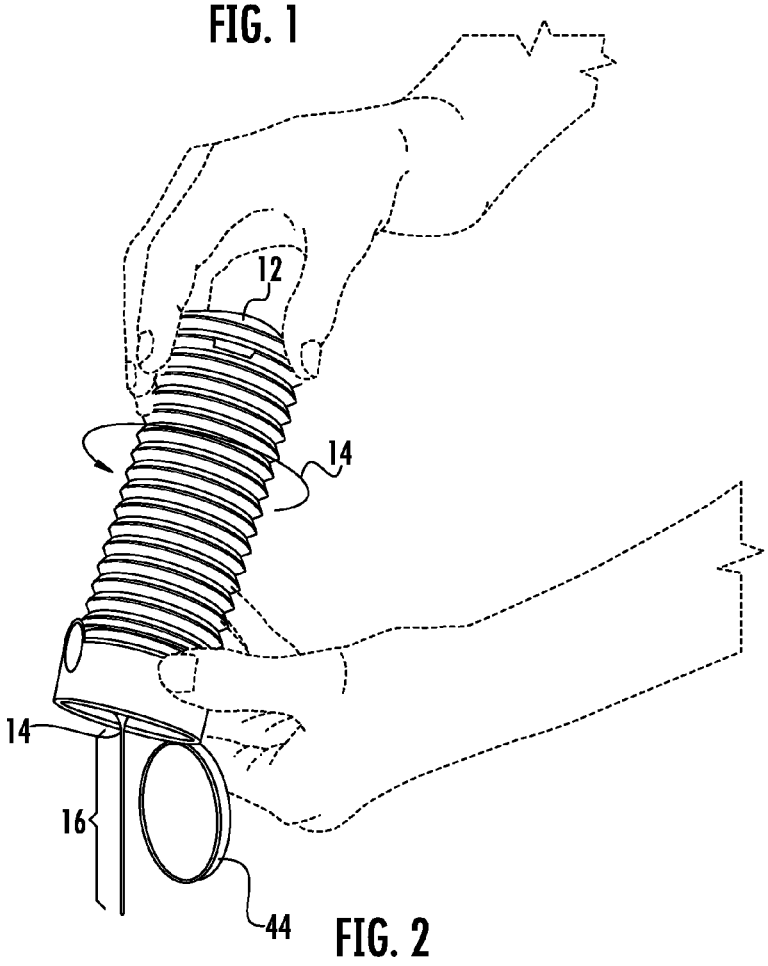
FIG. 2 is a side elevational view of a user employing the present invention and showing how the bottle section is turned with respect to the held cap element, to mechanically dispense liquid, viscous material or other matter through the nozzle of the cap element or the pour opening.

FIGS. 1 and 2 depict the present invention, a turnable or twistable and collapsible preferably liquid yet useful for viscous materials, indeed, other matter, too, container. It dispenses precise dosing as can be easily sensed (audibly or tactilely by the user). The container includes a main housing or hollowed chamber or bottle section 2 and a base or cap element 4. Cap element 4 fits around the bottom of bottle section 2. At time of purchase by a consumer or intended user, the bottle section 2 is initially filled with a fluid, viscous, or other material 16. The unique shape/design of the cap element 4 and the bottle section 2 allows the bottle section to collapse into the cap element as a user twists/rotates the bottle section 2 with respect to the cap element, possibly by using the twist grip 12. Either or both ends of the cap element and the bottle section can be provided with a flat surface (a hinged sealing cap for the cap element, for safety purposes) so that the container can sit with its closed bottle section or its closed cap element on a table surface.

As can be appreciated by the Figures, the bottle section 2 is provided with a continuous set of exterior screw threads (a single continuous parallel plane) 8 and thus assumes a bellows-like shape. The external screw threads 8 extend uniformly about the outside circumference of the bottle section and substantially, preferably, extend from one closed end 40 to the open end 28 of the bottle section. The screw threads 8 of the bottle section have exterior edges 18 and are spaced at a distance, P1. Preferably, uniformly spaced along the outside edges 18 of the screw threads 8 are two or more recesses 10 or discontinuities in the edges 18 of the screw threads 8. They can be spaced, for example, one per complete rotation about the bottle section—2, 3 even 4 per rotational of the screw thread, or even only on alternate or every third or fourth rotation of screw thread, for example.

The bottle cap element 4 is shown in FIGS. 1 through 9. Cap element 4 is provided with a set of internal screw threads 6 which are of the same outside diameter as the external screw threads 8 of the bottle section 2. The screw threads of both elements, bottle section 2 and cap element 4, are matingly engageable but of different longitudinal spacing. Here, cap element 4 is provided with internally directed screw threads 6 of distance apart of P2, where the density of screw threads or P2 is greater than the density of screw threads of the bottle section, P1. Thus, for example, if the spacing of the screw threads 8 of the uncollapsed bottle section 2 is 10 rotations or turnings per 10 inches of length of bottle section (uncollapsed), i.e., one rotation per inch of length, then the screw thread spacing P2 of the cap element 4 is tighter or 5 or 10 rotations or turnings per longitudinal inch, for example, so that the length of the collapsible bottle section 2 can be collapsed, turned into and captured and held by the cap element 4, by it being only 1 or 2 inches of its length.

Cap element 4 is also provided with a resilient, radially and biased inwardly directed lug or tab (or finger) 54. It is adapted to preferably glide over the edges 18 of the screw threads 8 of the bottle section 2 until it snaps back, radially and inwardly directed, when it aligns with and cooperates with a discontinuity or recess 10 of the exterior screw threads 8 of the bottle section 2. This snapping back, a consequence of the resiliency of the lug or tab 54 and the manufacture of the parts preferably of strong yet resilient plastic, causes an audible click and/or a tactile feel or snap to occur, sensed by the user as he/she relatively rotates the bottle section 2 with respect to the cap element 4.

The cap element 4, sitting on the open end 28 of the bottle section 2, is intended to dispense liquid as the bottle section is moved or rotated with respect to the cap element 4. The cap element 4 is provided with an aperture or pour opening 14 for dispensing liquid or viscous material or matter 16. In an alternate embodiment of the invention, the opening or aperture 14 of the cap element 4 can be closed off by a hinged or safety seal mechanism 44 as seen in FIG. 2.

As the bottle section 2 is rotated, shown by movement in FIG. 2, the recesses 10 around the edge 18 of the exterior screw threads 8, one at a time, serially align with the protruding tab 54 or lug of the cap element 4. As the bottle section 2 is collapsed (by the interal screw threads of the cap element squeezing together the external screw theads of the bottle section 4) and as the bottle element is thus captured into the cap element 4, due to the incompressibility of the fluid 16 contained within the bottle section 2 and other physical factors, liquid, viscous material, etc. will be forced out of the bottle section 2, into the cap element 4, through opening 28 and then out of the aperture or pour opening 14 of the nozzle. This is a dispensing operation. When liquid is not being dispensed, the tab or lug 54 of the cap element 4 rests or sits lodged in a discontinuity or recess 10 of the bottle section 2 and this rotation prevention mechanism prevents any liquid 16 from passing through the aperture 14 of the nozzle of the cap element 4 unless further intentional manual rotation is sought to be accomplished. When a user wishes to dispense liquid or viscous material 16, the bottle section 2 is held such that the closed end 20 is upward and the cap element downwardly directed. Then the bottle section 2 is rotated (as seen in FIG. 2) relative to the cap element 4, easily dislodging tab or lug 54 from a recess 10. The tab or lug 54 will easily be dislodged by simple rotation of the bottom section 2 with respect to the cap element 4 and slide or glide over the outside edge 18 of the helical screw thread 8, allowing for collapsing of the bottle section 2 into the cap element and dispensing of material 16 through the opening 28 and then through the pour opening or aperture 14 of the nozzle of the cap element 2, at least until the tab 54 or lug snaps into the next successive recess 10. The resiliency of the tab 54 as it glides over the edge 18 of the screw threads 8 and then hits or seats into a next recess 10 causes a snap or click to be heard and felt. As shown in FIG. 2A, the clicking sound is heard and felt when the bottle section 2 is rotated with respect to the cap element 4, and the tab 54 quickly snaps into a recess 10. Since all of the recesses 10 are equally spaced throughout the spiral screw threads 8 of the bottle section 2 of the container 60, each successive click signals that a pre-determined measurement of liquid 16 has been dispensed. With every twist, and thus every click, more liquid 16 is dispensed, and each time, it is precisely the same measurement of liquid. This occurs because every turn of the bottle section 2 rotates the same helical distance, and thus the compression of the longitudinal length of the bottle section 2 is controlled. This provides the advantage that a user who is attempting to dispense a given amount of liquid, i.e. medicine, will always get the precise measurement required.

As understood, as the material is dispensed from the bottle section 2, out of the aperture 14 of the nozzle of the cap element 4, the cap element 4 captures and holds the bottle section 2. The bottle section 2 thus decreases or is collapsed in length, being held within the cap element 4.

Figure 2B:
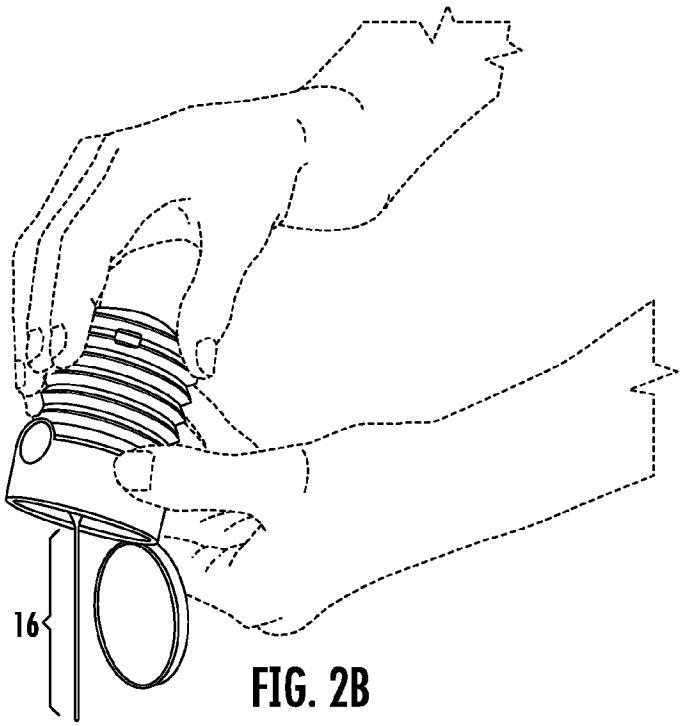
FIG. 2B is a side elevational view of the present invention, similar to that of FIG. 2A, after the bottle section has been turned and partially collapsed into the cap element and fluid or viscous material or matter dispensed through the pour opening.
Figure 2A:
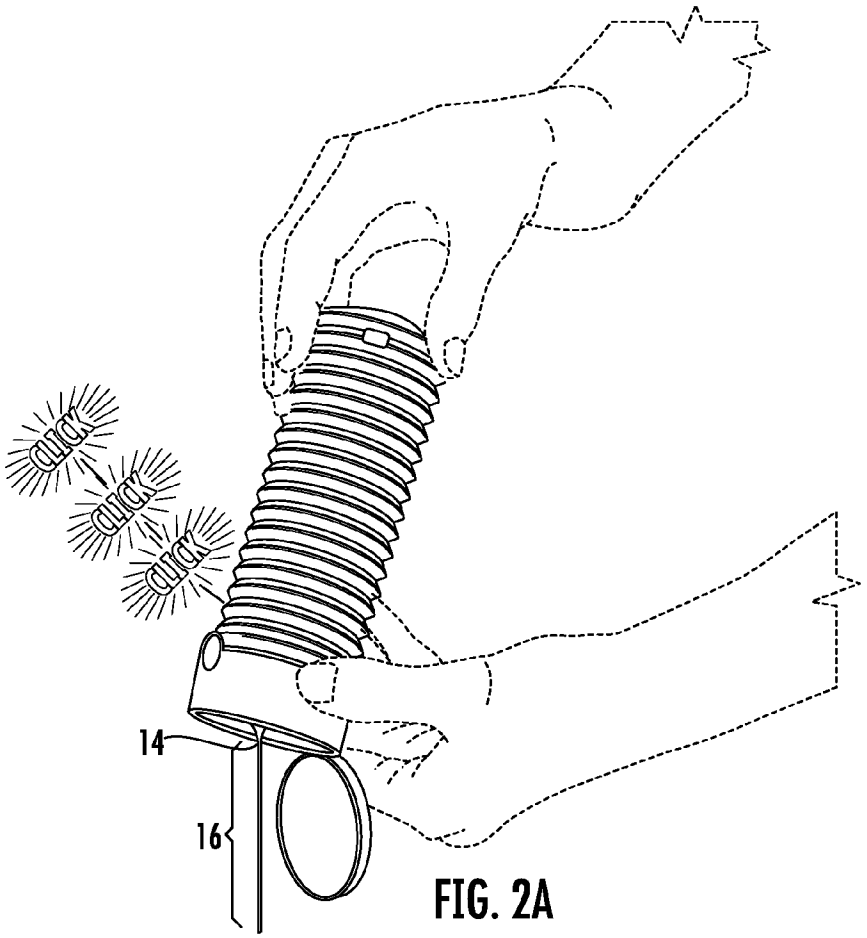
FIG. 2A is substantially identical to FIG. 2, except schematically and additionally showing that as liquid is dispensed by relative rotation of bottle section with respect to cap element, the audible click sound will occur (depicted in the Figure) and liquid will be dispensed trough the pour opening.
Figure 3:
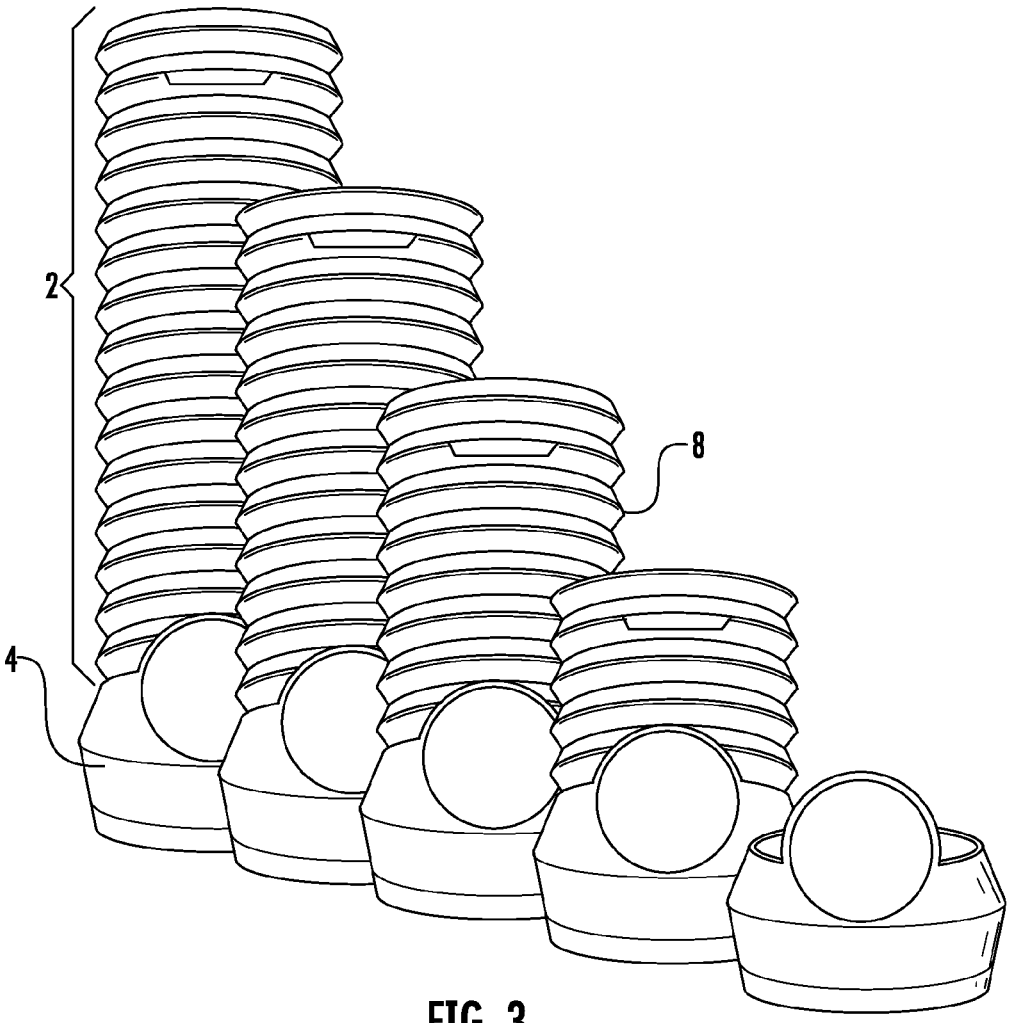
FIG. 3 is a side perspective view of multiple views of the same bottle section as it would appear in shrinking in size from the full, initial version at maximum height (towards the rear of the drawing) down to when the bottle section has been rotated and collapsed substantially fully for capture inside the cap element and all liquid has been seemingly dispensed (as seen in the foreground of the drawing). This shows that as liquid is dispensed, the length of the device decreases or, as the screw threads of the bottle section are captured by the tighter spaced (in the longitudinal direction) screw threads of the cap element, liquid is dispensed and the length of the bottle section shrinks.
Figures 4, 4A, 4B:
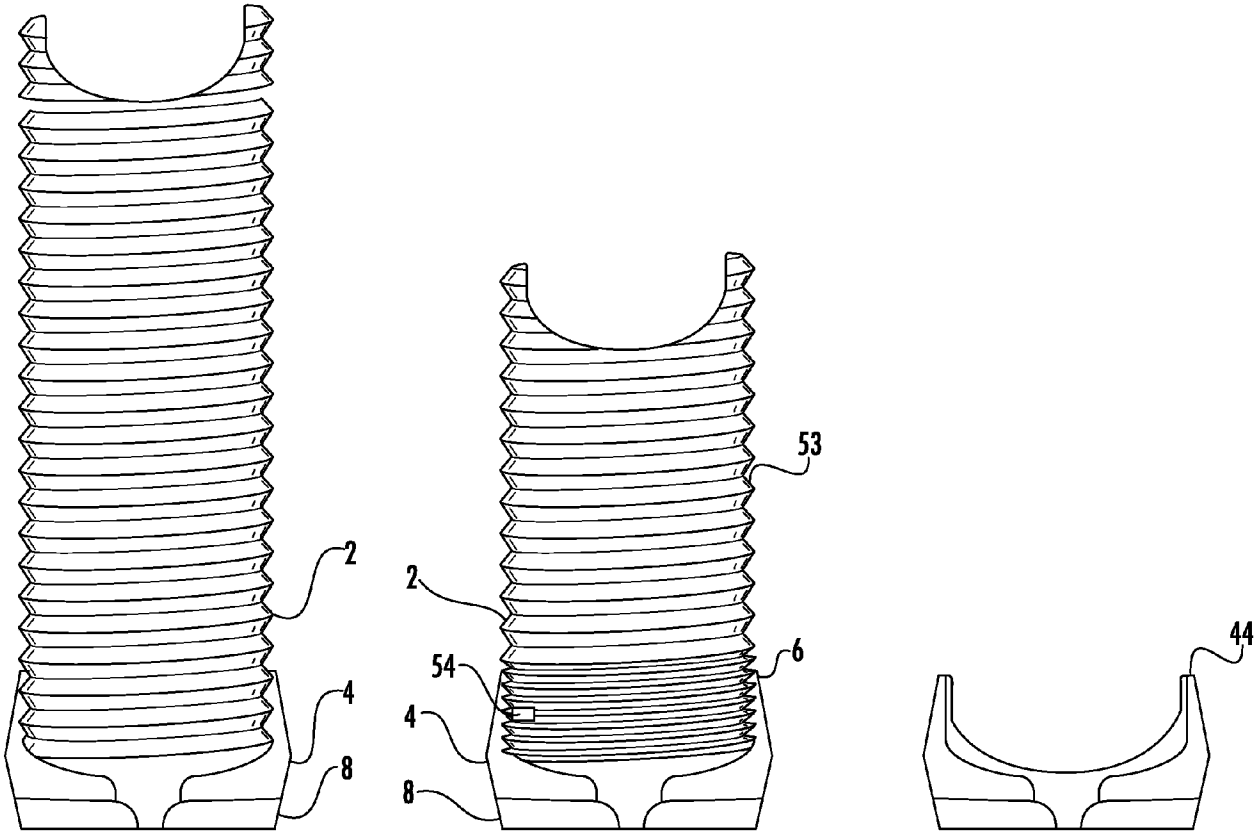
FIG. 4 is a cross sectional view of one embodiment of the present invention and shows the bottle section; the cap elment and a hinged cover or safety seal, when the bottle section is in its initial or full capacity.
FIG. 4A is a cross sectional view of the present invention after partial dispensing of material from the bottle section, through the pour opening or aperture of the cap element, also showing the screw threads of the bottle section being captured and stored within the internal and hollow section of the cap element, a consequence of the tighter spacing of the mating yet internal screw threads of the cap element. The hinged safety seal or cover is shown in position and rests on the table surface.
FIG. 4B is a cross sectional view of the present invention after all liquid has been dispensed and showing the entirety of the bottle section being collapsed and contained within the cap element, with the safety cap hinged over the pour opening and resting on a table top.

As shown in FIG. 2B, as the bottle section 2 is rotated, the tab 54 continues to pass to each successive recess 10, thereby allowing dispensing liquid from the bottle section but alerting the user that a predetermined dose of fluid material has been passed through the pour opening. Dispensing also means, however, that the bottle section 2 collapses into cap element 4. The threads 8 on the exterior of bottle section 2 mate with and screw into the internal screw threads 6 of cap element 4. When the bottom bottle section 2 reaches the top 44 of cap element 4 (see FIG. 4B) it comes to a stop, the contents of the bottle section 2 have been substantially dispensed and the device can be discarded. As bottle section 2 was turned into and captured by the cap element 4, the empty portion of the bottle section 2 begins to be captured and compressed into the cap element 4. This continues until the entire bottle is empty and collapsed into cap element 4. For the entire duration of the dispensing of liquid from the bottle element 2, each successive rotation or partial rotation dispenses the exact same amount of liquid 16. This is shown in FIG. 3, which portrays the bottle section 2 at different stages of the rotation, from full height before any liquid has been dispensed to a completely empty and collapsed stage. FIGS. 4, 4A, and 4B show the same progression of rotation and collapse, but are a cross sectional view and only show 3 stages—when the device is new and no liquid yet dispensed; some liquid having been dispensed (FIG. 4A) and when all liquid has been dispensed (FIG. 4B).

Figure 5B:
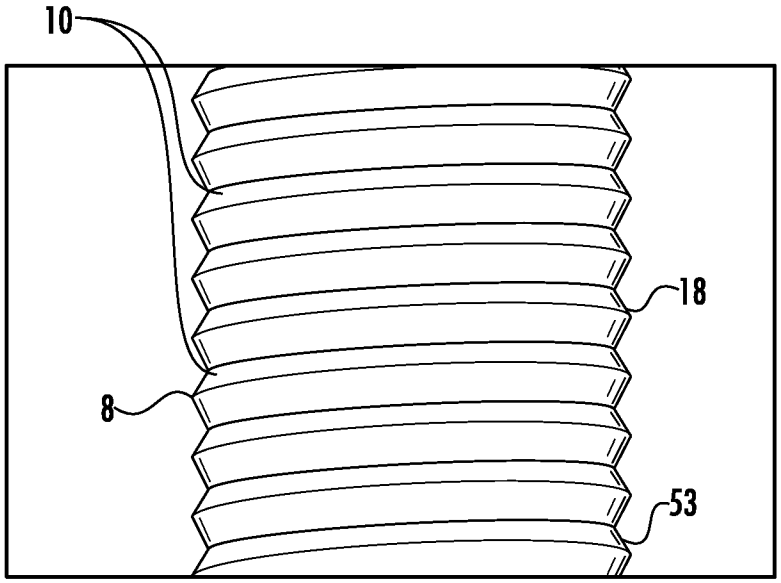
FIG. 5B is an enlarged and partial perspective view of the vertically aligned and uniformly spaced discontinuities, projections or recesses in the screw threads of the bottle section of the present invention.
Figure 5A:
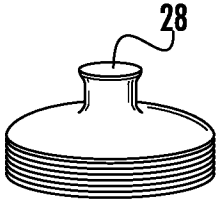
FIG. 5A is a front and perspective view of the present invention and, specifically, shows the bottle section of the present invention, shown unattached to the cap element, but showing the shape and relative size of the bottle section in comparison to that shown in FIG. 5, when fully collapsed as its screw threads are collapsed into the screw threads of the cap element (not shown). Again, the pour opening or central aperture is shown for the bottle section.
Figure 5:
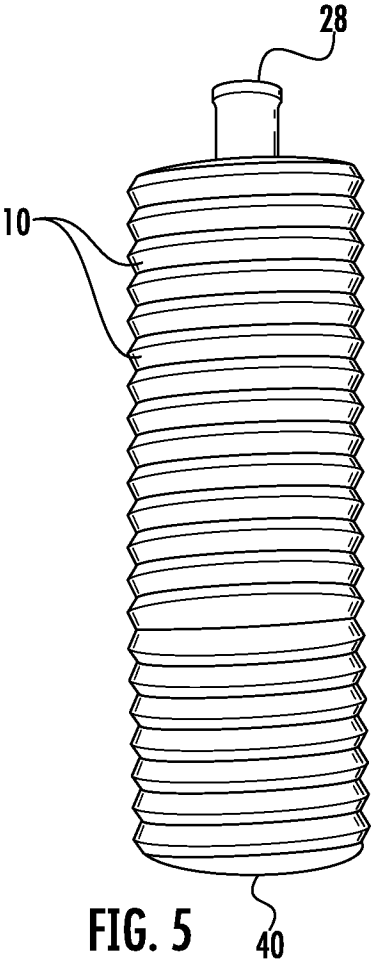
FIG. 5 is a front perspective inverted view of the bottle section (separate from the cap element and safety cover) shown in FIG. 4 and shows the helical screw threads on the outside of the bottle section and the central pour opening or aperture of the bottle section.
Figure 6:
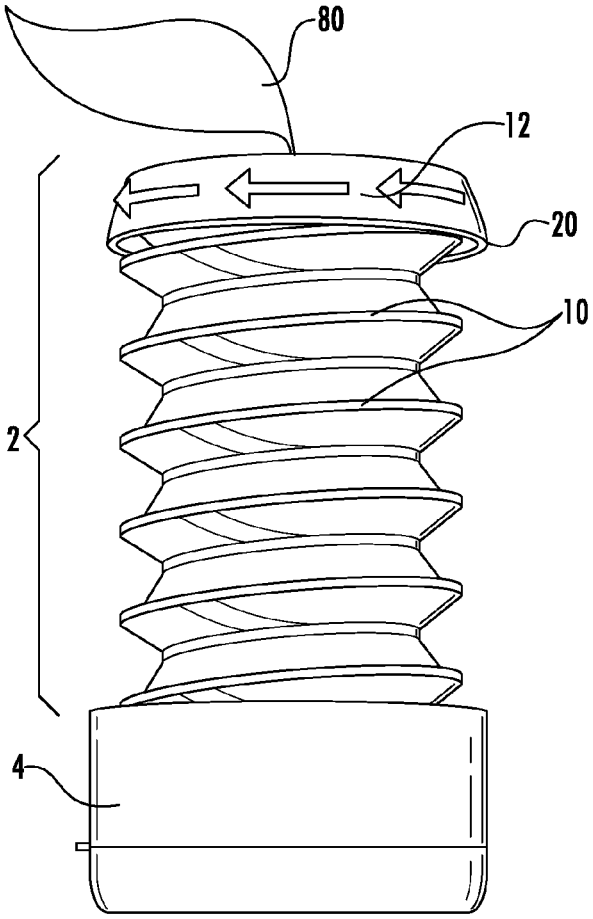
FIG. 6 is a front perspective view of another embodiment of the present invention at its initial or full i.e., uncompressed height, i.e., prior to any collapsing for dispensing of fluid and showing a turning top, a cap element and a leaf-life top projection for displaying text relating to the invention.
Figure 6A:
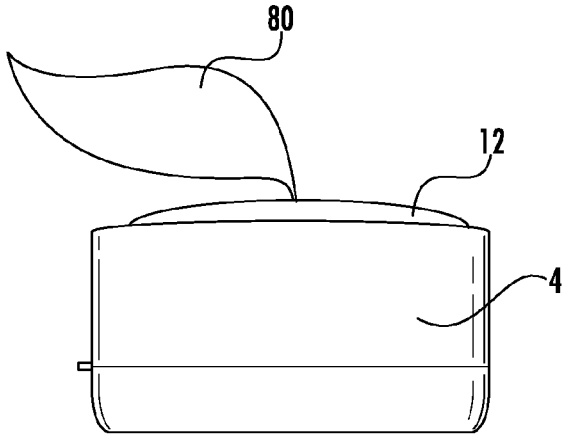
FIG. 6A is a front perspective view of the embodiment shown in FIG. 6, when the bottle section is completely empty (fluid material fully dispensed) and the bottle section is fully collapsed and contained within the cap element.

As seen in FIG. 5, the bottle section 2 has a basic cylindrical shape (it is a one-end closed cylinder with helical screw threads 8 on its exterior). The bottle section is preferably provided with equally spaced discontinuities—recesses or bumps or projections 10 on either the outside edge of the screw threads or on one of the planes that define the screw threads. These relate to and guide the user towards a metered and precisely controlled or suggested amount of dispensing of liquid 16. A close-up view of these recesses or ridges 10 is shown in FIG. 5B. At the open end of bottle section 2 is an opening or hole 28 through which the liquid 16 passes and the liquid is released into the cap element 4 and through the aperture 14 of the cap element's nozzle piece. There is an ergonomic bottle end cap or twist grip 12 (See FIG. 6 and for the embodiment shown in FIG. 7) at the closed end 20 or the top of bottle section 2. Rotation of the twist grip 12 causes the bottle section to rotate. The cap element 4, covering the open end of the bottle section, as mentioned, can be provided with a hinged sealing cover or lid 44. Resilient tab 54 shown in cross section in FIG. 4A is provided on the inside of the cap element 4. The tab 54 is preferably resilient, plastic and radially directed inwardly towards the central longitudinal axis of the bottle section and the cap element. The tab or lug 54 will normally (unless directed out by the camming action of the edge 18 of the screw threads 8 of the bottle section 2 or the planar surface of the screw thread) protrude radially inwardly from the cap element 4. It will, however, interact with the surface discontinuities or recesses 10 of the edge 18 of the exterior screw threads 8 of the bottle section 2 or on one of the helical ramps or the planar surface defining the screw thread. When the tab or lug 54 comes into contact with each successive recess or discontinuity 10 on the edge 18 of the exterior screw threads 8 of the bottle section 2 (or a recess or discontinuity 10 on the planar surface 53 of the screw threads) as the bottle section 2 is turned with respect to the cap element 4, the tab will slip or snap into the recess, as it is resilient and is biased towards the radially inwardly orientation. As further rotation of the bottle section with respect to the cap element 4 progresses, the bottle section 2 gradually collapses into cap element 4, and the screw threads 8 of the bottle section 2 begin to tightly stack on top of one another confined by and within the screw threads 6 of the cap element 4, as is shown in FIGS. 4B and 6A.

Figure 9:
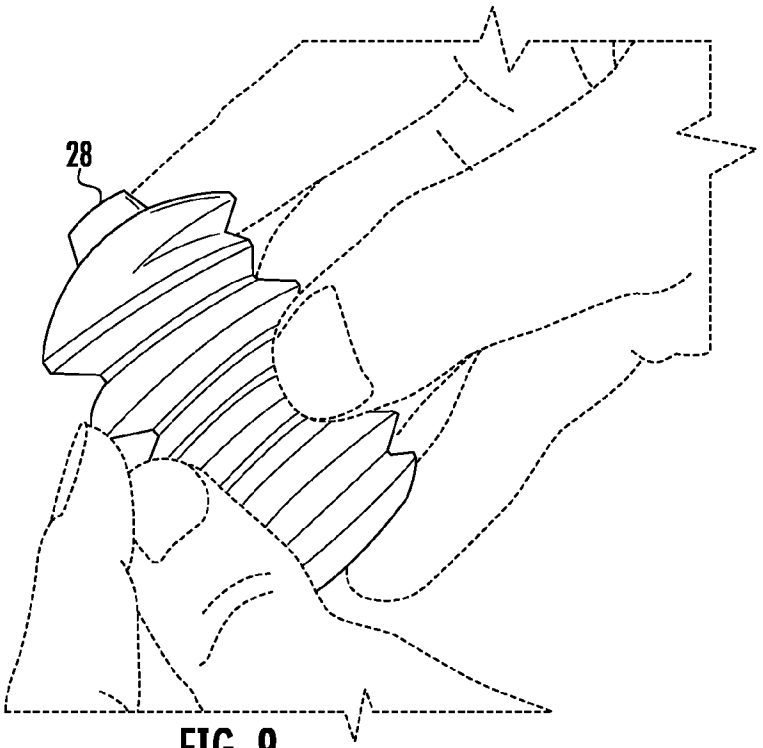
FIG. 9 is a front perspective view of the bottle section (and user's hands applying a stick to the aligned surface discontinuities or recesses in the outside screw threads of the bottlw section, and also showing the pour opening at the top of the bottle section.
Figure 7:
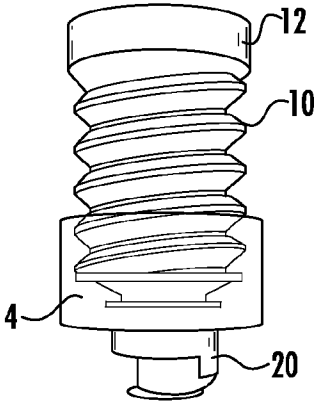
FIG. 7 is a front perspective and partially exposed view of another and the preferred embodiment of the bottle section and cap with a collar for compressing and capturing the collapsed-by-turning bottle section of the present invention, showing the small bottle section beforeit has been collapsed.
Figure 8:
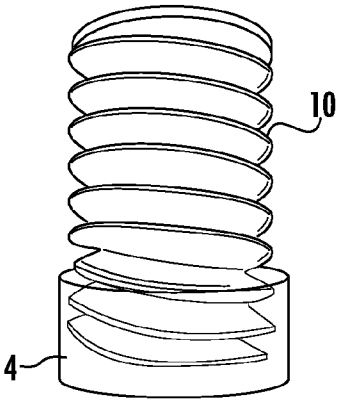
FIG. 8 is a front perspective view of another embodiment of the present invention showing the cap, collar, and exterior helical screw threads of the bottle section.

FIGS. 7, 8 and 9 show internal mechanical elements of an alternate embodiment (the preferred embodiment) of the present invention as the cap is replaced by a different end cap 70 (See FIG. 10) and a hinged safety cap 72. The end cap 70 and the safety cap 72 are fixed in rotation to the bottle section 2 such that rotation of the bottle section 2 will result in rotation of the end cap 70 and the hinged (open or closed) safety cap 72 or the pour opening of the device. In the embodiment of the invention shown in FIGS. 7, 8 and 10, 11, and 12, the collar can be transparent (although surely not required) so that the relative rotation and capturing of the bottle section within the collar can be visually observed. The collar 60 is a short cylinder with a flat outside wall 61 which is larger in diameter than the diameter of the screw threads 8 of the bottle section 2. An inwardly directed top flange 62 and a similar inwardly directed bottom or holding flange 64 are provided. The inside faces 65 and 67 of the top flange 62 and the holding flange 64, respectively, have an interior diameter which is greater than the open mouth 71 of the bottle section 2 but smaller in diameter than the screw threads 8 of the bottle section. This ensures that the collar 60, once installed on the bottle section 2, does not accidentally slip off. The top flange and the bottom or holding flange will mechanically cooperate with the screw threads 8 of the bottle section 2, so that, upon turning of the bottle section with respect to the collar, the bottle section will collapse as the screw threads 8 pass by the top flange 62 and the collapsed screw threads will become captured and stack upon one another within the hollow head space of the collar. It should be appreciated that the top flange 62 will "train" or direct the external screw threads of the bottle section as the two are relatively rotated (collar with respect to bottle section) and the collapsed bottle section will collect within and be housed by the space between the top flange and the holding flange. Thus, the collar, like the cap element, both operate as collapsing and holding sections for that portion of the bottle section which has passed by the top flange of the collar or the uppermost screw thread of the cap element. The collapsed portion of the bottle section is collapsed and maintained between that top screw thread or top flange of the collar and the bottommost thread of the cap element, or, in the case of the collar, by the holding flange. Thus, the bottle will collapse in longitudinal length and the contents 16 of the bottle section 2 will pass through the open end 28 or 71, into the end cap 71 and then pass through the pour opening (as the safety cap 72 is hinged open).

Also, FIGS. 7, 8 and 10-12 show aspects of the bottle section 2 and its engagement with the collar 60, and how the bottle section collapses into the collar 60. Additionally, open end 28 or 71 of the bottle section 2 is shown which is the exit orifice through which the liquid 16 is dispensed into the end cap 70 or cap element 4, before being dispensed through aperture or pour opening 14 of the end cap 70 or cap element 4.

The shape of the bottle section 2 is easily achieved using traditional blow molding techniques. The continuous screw threads 8 on the exterior circumferential surface on this bottle section are natural stiffeners, reinforcing the bottle shape. This enables the walls of the bottle to be thinner than conventional walls of liquid-holding containers which can save money long-term on material costs as well as help promote a green company agenda (it may also save in transportation costs due to light weight of the containers especially when shipped in bulk, empty or filled with liquid material 16). The injection molded end cap or cap element 4 can be custom shaped on its exterior to adjust to different company brand images. So, too, the twist grip 112 can be designed for a particular shape or brand of product. So, for example, in the embodiment shown, an attractive leaf-like extension 80 is shown in FIGS. 6 and 6A. As discussed above, the base of the cap element 4 or the top of the safety cap 72 of the end cap 70 can be flat so that the container (comprised of bottle section 2 and either cap element 4 or end cap 70, with collar 60 and safety cap 72) can stably sit on a table surface on either end, i.e., on the flat base of cap element 4 or top of the safety cap 72 (in the embodiment having a collar 60) or on the closed and flat end 40 of the bottle section 2.

As best seen in FIGS. 11 and 12, the collar 60 is provided with an inwardly protruding, resilient tab or lug 54. It is intended to mechanically cooperate with the discontinuities 10, i.e., the recesses or ridges on the sloped walls or planar surface 53 of the screw threads 8 or the recess 10 located in the edge 18 of the screw thread 8. When the tab or lug 54 of the collar 60 aligns with the discontinuity or recess 10 (whether on the planar surface 53 or the edge 18 of the screw threads 8) a mechanical click will occur, i.e., the resilient tab or lug 54 will snap back into its inwardly biased position. This will preferably be audible and will also be felt by the user. The tab or lug 54 will snap into its radially projected position as it is no longer cammed outwardly by the sloped surface or planar surface 53 of the screw threads 8 nor the edge 18 of the same.

When it is desired to dispense measured amounts of liquid 16 from inside the bottle section 2, a user holds the cap element 4 or the collar 60 with one hand while relatively rotating the bottle section 2 by means of the twist grip 12. When the bottle section 2 is rotated or turned and collapsed into the cap element 4 or the collar 60, the compression of the bottle mechanically pushes on and dispenses the liquid 16 through the open mouth 71 of the bottle then through the opening of the end cap 70 (of the embodiment of FIGS. 10-12) or through the aperture 14 of the cap element 4. The use of evenly spaced discontinuities or recesses 10 along the planar surface 53 of the threads 8 or the edge 18 of the threads 8, of the bottle section 2, in mechanical cooperation with the resilient, inwardly biased and projecting tab 54 or lug of the cap member 4 or of collar 60, cause an audible "snap" or "click" or a tactile click that signals/alerts a user when the tab or lug is aligned (by turning of the bottle section in relation to the tab or lug of the cap element or the collar) that an exact measured dose of the liquid has been dispensed. The distance between recesses or surface discontinuities 10 in the outside edge 18 of screw threads 8 of the bottle section 2 or in the planar surface 53 of the screw threads 8, the diameter of the bottle, and the slope and spacing or density of the screw threads, etc. all factor into the amount of liquid dispensed with each full or partial relative turn of components (bottle section vis a vis the cap element or collar). Each snap or click, whether audible or tactilely sensed, corresponds to that relative turning of the bottle section with respect to the cap element or the collar, and thus correspond to the amount of liquid dispensed. These variables—diameter, slope of screw threads, spacing of screw threads, diameter of pour opening or apertures of bottle section and end cap or cap element, etc., can be adjusted in the design of the bottle to accommodate different dosage requirements and can be integrated into different bottle sizes.

One embodiment of the present invention could be used as a concentrated laundry detergent dispenser where twisting 1-click means light load, 2-clicks mean medium load, and 3-clicks mean enough detergent for heavy loads. In another embodiment, the amount of rotation of the bottle section could equal teaspoons of medicine to be taken. According to another embodiment of the invention, the outside of the bottle section can be provided with text (quantities, a number of days, date, day of the week, etc.) or other markings to facilitate the precise turning and dosing of materials by the relative turning of the cap element (or collar) with respect to the bottle section.

When the bottle is empty of fluid or the screw threads fully contained within the cap element or the collar (for the embodiment of FIGS. 10-12) the bottle can be discarded, preferably into a suitable plastic recycling container or process. Alternatively, the bottle can be removed (by unscrewing) from the cap element or the collar and a new bottle section, fully loaded with material to be dispensed, can be connected.

It will be understood by those of ordinary skill in the art that various changes may be made and equivalents may be substituted for elements without departing from the scope of the invention. In addition, many modifications may be made to adapt a particular feature or material to the teachings of the invention without departing from the scope thereof. Therefore, it is intended that the invention not be limited to the particular embodiments disclosed, but that the invention will include all embodiments falling within the scope of the claims.

What I claim is:

1. A collapsible container for dispensing materials in predetermined dosage amounts, comprising:

a substantially cylindrical hollow bottle section having external screw threads and made of a material which allows the same to collapse along its length while preserving its integrity as a holder of said materials;

a substantially hollow, collapsing element secured to said bottle section and relatively turnable with respect thereto, having at least one interior-directed screw-like thread mating with said external screw threads of said bottle section and also comprising a hollow, capturing section for the collapsed portion of said bottle section produced by relative turning of said bottle section with respect to said collapsing element;

said external screw threads having two or more spaced discontinuities;

said collapsing element having an inwardly projecting, resilient tab which glides on said external screw threads when said bottle section is turned with respect to said collapsing element until said tab is aligned with one of said discontinuities, said tab element and said discontinuities, when aligned, thus providing an audible and/or tactile indication that a predetermined angular relative rotation of said bottle section with respect to said collapsing element has been accomplished.

2. A container as claimed in claim 1, wherein said discontinuities are located on said exterior screw threads at a frequency of one, two, three, or four per rotation or on alternate or multiple(s) of rotations.

3. A container as claimed in claim 1, wherein said collapsible element is a collar comprising a collapsing flange, a collecting flange, and a sidewall, the diameter of said side wall being greater than the diameter of said external screw threads of said bottle section.

4. A container as claimed in claim 1 wherein multiple interior-directed screw-like threads are provided to said collapsing element, said interior-directed screw-like threads of said collapsible element and said externally-directed screw threads of said bottle section mating with one another, and the spacing of said exterior screw threads of said bottle section is significantly greater than the spacing of said interior-directed screw-like threads of said collapsible element.

5. A container as claimed in claim 1 wherein said bottle section, when turned to fully dispense said materials, is fully captured within said collapsing element.

6. A container as claimed in claim 1, wherein said bottle section is initially, before relative rotation, about 5 times or more in length than said collapsing element.

7. A container as claimed in claim 1 wherein said bottle section is provided with a safety cap.

8. A container as claimed in claim 1 wherein said collapsible element is adjacent a cap end and either said bottle section and/or said cap end are provided with a flat surface to enable the same to sit stably on a flat surface.

9. A container as claimed in claim 1 wherein said collapsible element is a collar surrounding the open end of said bottle section and said collar comprises an inwardly directed flange for collapsing said bottle section within said collar as said bottle section is rotated relative to said collar.

10. A container as claimed in claim 9 wherein said collar is further comprised of an end flange which with said inwardly directed flange comprise a holding area for the collapsed section of said bottle section.

11. A container as claimed in claim 9 wherein the interior diameter of said collar is greater than the exterior diameter of said external screw threads of said bottle section.

12. A container as claimed in claim 9 wherein said bottle section is provided with a cap end which is non-rotatively secured to the aperture of said bottle section such that said cap end and said bottle section rotate together.

13. A container as claimed in claim 9 further comprising a liquid or viscous material within said bottle section for selective and precise dosing as said bottle section is rotated with respect to said collapsing element.

14. A container as claimed in claim 1 wherein said tab is biased inwardly and rides on and over the planar surface of said exterior screw threads of said bottle section until said tab snaps into said discontinuity.

15. A container as claimed in claim 1 wherein said discontinuities are recesses.

16. A container as claimed in claim 1 wherein said tab rides upon the edge of said external screw threads.

17. A container as claimed in claim 1 further comprising a safety seal.

18. A container as claimed in claim 1 wherein said collar is removably attached to said bottle section.

* * * * *